United States Patent [19]

Newman et al.

[11] Patent Number: 4,872,857

[45] Date of Patent: Oct. 10, 1989

[54] OPERATION OPTIMIZING SYSTEM FOR A MARINE DRIVE UNIT

[75] Inventors: Neil A. Newman, Omro; Herbert A. Bankstahl; John M. Griffiths, both of Fond du Lac; Lyle M. Forsgren, Oshkosh; Wayne T. Beck, Fond du Lac, all of Wis.

[73] Assignee: Brunswick Corporation, Skokie, Ill.

[21] Appl. No.: 235,288

[22] Filed: Aug. 23, 1988

[51] Int. Cl.[4] ..... B63H 5/12

[52] U.S. Cl. ..... 440/1; 440/2; 440/53; 440/61; 248/642

[58] Field of Search ..... 440/1, 2, 53, 61; 248/641, 642

[56] References Cited

U.S. PATENT DOCUMENTS

| | | | |
|---|---|---|---|
| 4,318,699 | 3/1982 | Wenstadt et al. | 440/1 |
| 4,449,945 | 5/1984 | Ferguson | 440/61 |
| 4,718,872 | 1/1988 | Olson et al. | 440/1 |
| 4,778,414 | 10/1988 | Taguchi | 440/1 |

*Primary Examiner*—Sherman D. Basinger
*Assistant Examiner*—Thomas J. Brahan
*Attorney, Agent, or Firm*—Robert C. Curfiss

[57] ABSTRACT

A system for optimizing the operation of a marine drive of the type whose position may be varied with respect to the boat by the operation of separate lift and trim/tilt means includes an automatic control system which stores preselected drive unit positions for various operating modes and is operative to return the drive unit to any pre-established position by pressing a selected operating mode positioning button. The various operating modes may include cruising, acceleration, trolling and trailering position, any of which may be selectively modified to accomodate changes in both operating or environmental conditions. This system may incorporate other optimization routines and/or automatic engine protection systems to provide virtually complete push button operation for complex marine drive unit positioning mechanisms.

18 Claims, 7 Drawing Sheets

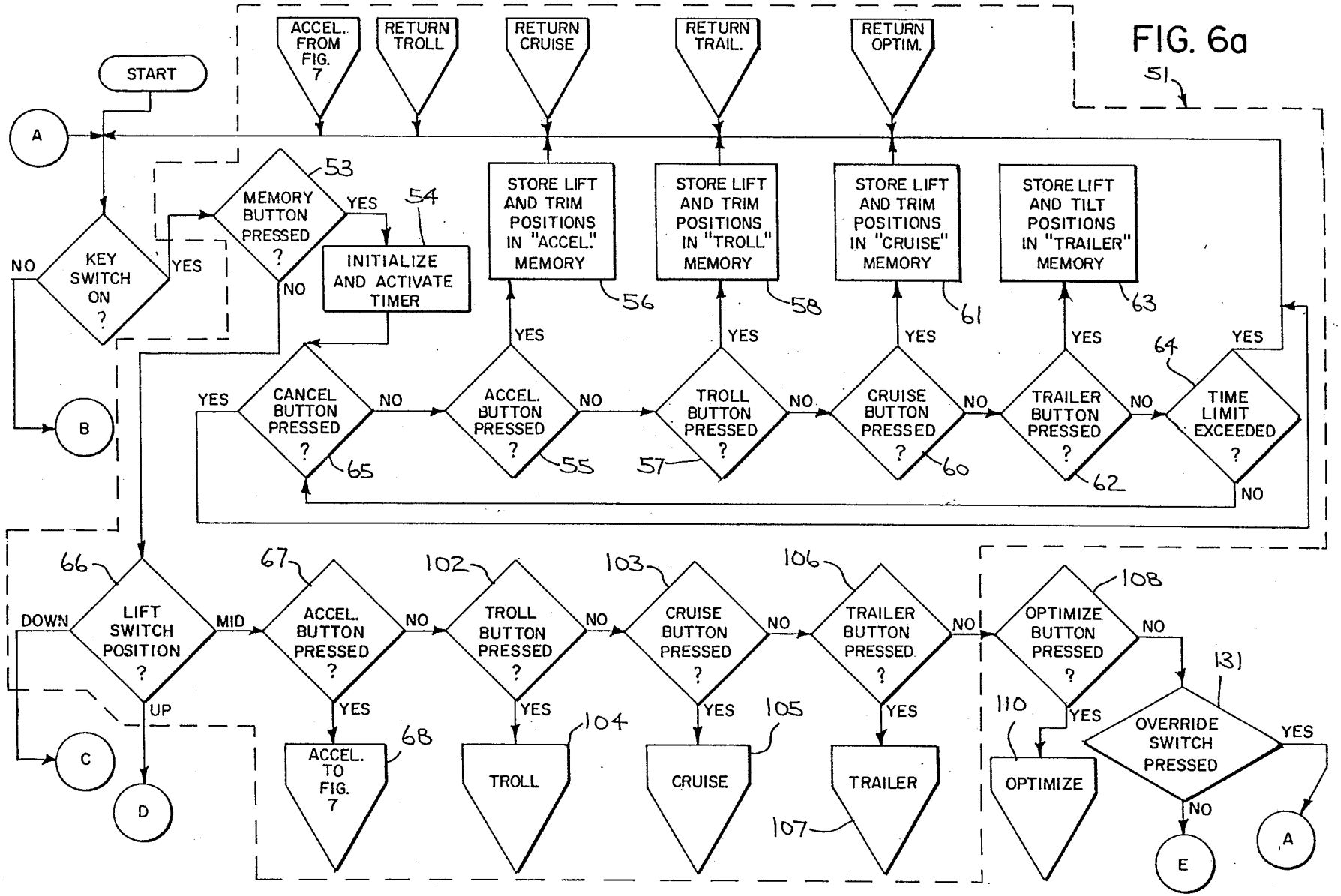
FIG. 6a
51
START
KEY SWITCH ON ?
YES
NO
A
B
MEMORY BUTTON PRESSED ?
53
INITIALIZE AND ACTIVATE TIMER
54
ACCEL. FROM FIG. 7
RETURN TROLL
RETURN CRUISE
RETURN TRAIL.
RETURN OPTIM.
STORE LIFT AND TRIM POSITIONS IN "ACCEL." MEMORY
56
STORE LIFT AND TRIM POSITIONS IN "TROLL" MEMORY
58
STORE LIFT AND TRIM POSITIONS IN "CRUISE" MEMORY
61
STORE LIFT AND TILT POSITIONS IN "TRAILER" MEMORY
63
CANCEL BUTTON PRESSED ?
65
ACCEL. BUTTON PRESSED ?
55
TROLL BUTTON PRESSED ?
57
CRUISE BUTTON PRESSED ?
60
TRAILER BUTTON PRESSED ?
62
TIME LIMIT EXCEEDED ?
64
LIFT SWITCH POSITION ?
66
DOWN
MID
UP
C
D
ACCEL. BUTTON PRESSED ?
67
ACCEL. TO FIG. 7
68
TROLL BUTTON PRESSED ?
102
TROLL
104
CRUISE BUTTON PRESSED ?
103
CRUISE
105
TRAILER BUTTON PRESSED ?
106
TRAILER
107
OPTIMIZE BUTTON PRESSED ?
108
OPTIMIZE
110
OVERRIDE SWITCH PRESSED
131
E

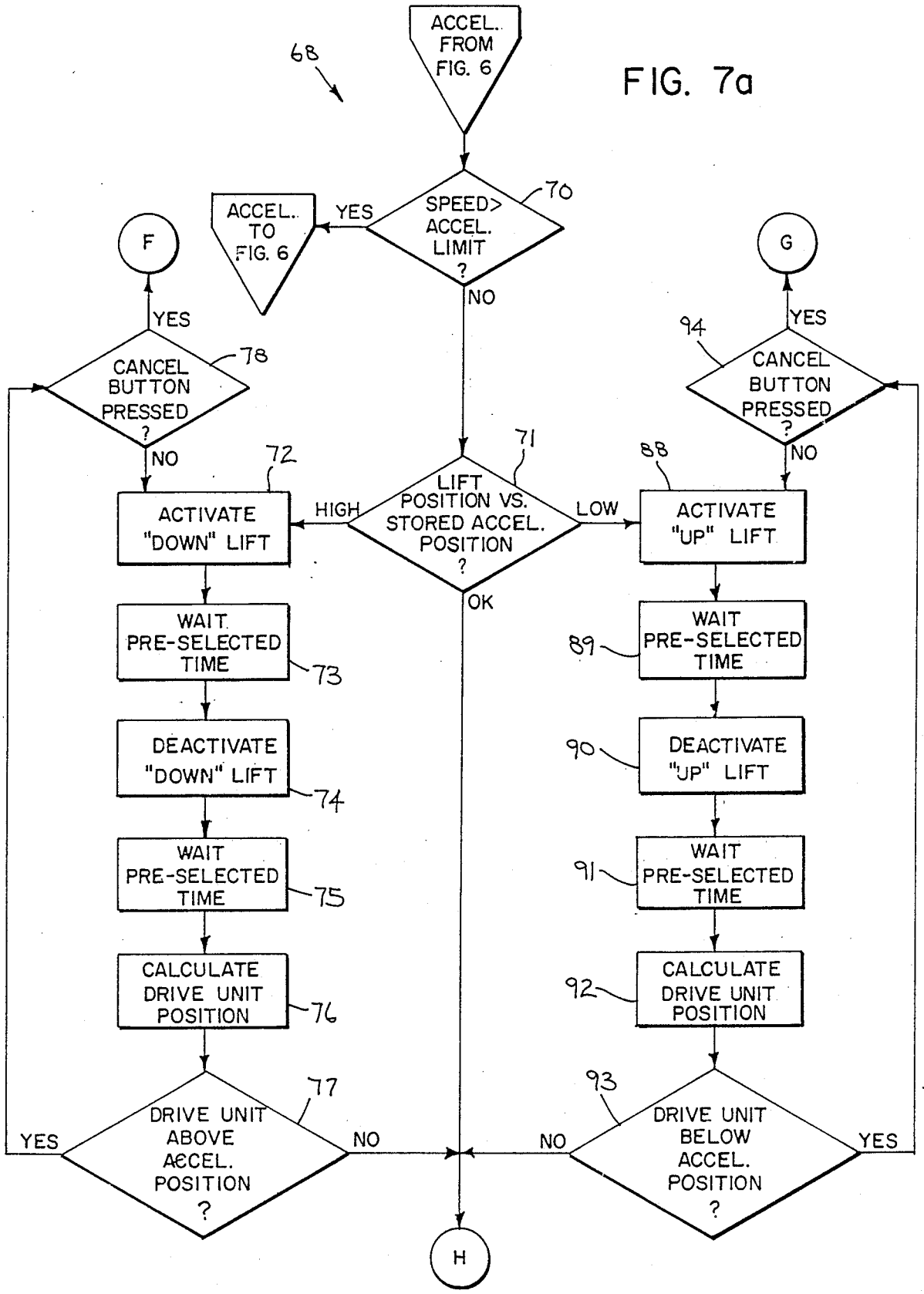
68
ACCEL. FROM FIG. 6
FIG. 7a
SPEED> ACCEL. LIMIT ?
70
YES
ACCEL. TO FIG. 6
NO
F
G
YES
CANCEL BUTTON PRESSED ?
78
NO
94
YES
CANCEL BUTTON PRESSED ?
NO
72
71
88
HIGH
LIFT POSITION VS. STORED ACCEL. POSITION ?
LOW
ACTIVATE "DOWN" LIFT
ACTIVATE "UP" LIFT
OK
WAIT PRE-SELECTED TIME
73
89
WAIT PRE-SELECTED TIME
DEACTIVATE "DOWN" LIFT
74
90
DEACTIVATE "UP" LIFT
WAIT PRE-SELECTED TIME
75
91
WAIT PRE-SELECTED TIME
CALCULATE DRIVE UNIT POSITION
76
92
CALCULATE DRIVE UNIT POSITION
77
93
YES
DRIVE UNIT ABOVE ACCEL. POSITION ?
NO
NO
DRIVE UNIT BELOW ACCEL. POSITION ?
YES
H

OPERATION OPTIMIZING SYSTEM FOR A MARINE DRIVE UNIT

BACKGROUND OF THE INVENTION

The present invention relates to a system for optimizing the operation of a marine drive unit and, more particularly, to a system for automatically returning a drive unit to a predetermined optimal position for any one of several conventional operating positions.

The drive units for marine propulsion devices, including outboard motors and stern drives, are typically supported from the boat transom by a drive mounting assembly. Various types of drive mounting assemblies are known, as for example a transom bracket for mounting an outboard motor directly on a boat transom or a gimbal ring assembly for similarly mounting a stern drive unit directly to the transom. A drive unit mounted directly on the boat transom may be trimmed by pivoting it about a generally horizontal axis in order to position the propellor and optimize thrust with respect to the plane of the boat. However, the vertical position of a drive unit mounted directly on the boat transom usually cannot be changed beyond the somewhat limited amount which inherently results from a trimming operation. Therefore, such a drive unit must typically be mounted in a compromise position at a fixed height with respect to the transom which will provide the best overall performance. Another type of drive mounting assembly is one which is capable of selectively supporting an outboard motor in either a raised or lowered position aft of the boat transom. Many of these so-called "transom extension" mounting assemblies are of the general type which include a pivotally connected quadrilateral linkage, generally in the form of a parallelogram.

Transom extension mounting assemblies have become increasingly popular on high performance and fishing boats powered by outboard motors where a lower position of the motor improves initial boat acceleration and a higher position enhances cruising speed by reducing gear case drag. Additionally, a higher motor position reduces draft, thereby enhancing shallow water and/or trolling operation. It is further known that relocating the motor aft of the transom improves the high speed handling characteristics of most boats.

Transom extension mounting assemblies which utilize a quadrilateral linkage arrangement cause the motor to be raised or lowered with respect to the boat by controlled collapse of the linkage via a powered operating system. A separate powered operating system is usually used to provide trim movement to the motor. The trim system may also provide maximum upward tilt movement to place the motor in a trailering position of a separate power system exclusively for tilting the motor to the trailering position may be utilized. U.S. patent application Ser. No. 181,685, filed Apr. 14, 1988, and entitled "Combined Trim, Tilt and Lift Apparatus for a Marine Propulsion Device", which is assigned to the assignee of this application, discloses an outboard motor transom extension mounting assembly comprising a quadrilateral linkage arrangement and utilizing separate hydraulic power means to effect vertical lift, trim and tilt movement to the motor. Such separate lift, trim and tilt systems are generally independently operable and manual adjustment of each of them by the boat operator to obtain optimum drive unit positioning is somewhat difficult and requires a fairly substantial level of operating skill. For example, substantially varying drive unit positions, both in terms of lift position and trim position, are required for trolling or shallow water operation, acceleration to cruising, and on-plane operation at cruising speed.

U.S. patent application Ser. No. 092,168, filed Sept. 2, 1987, entitled "Automatic Engine Lift for Outboard Motors," and Ser. No. 172,399, filed Mar. 24, 1988, entitled "Position Control System for a Marine Propulsion Device", both of which are also assigned to the assignee of this application, disclose means for controlling the movement and positioning of transom extension mounted outboard motors to avoid hazardous or undesirable operating conditions. The disclosed control systems operate automatically to lift or lower the motor with respect to the motor transom until the hazard or undesirable condition is eliminated.

U.S. Pat. No. 4,318,699 discloses a system for automatically trimming a marine drive unit in response to a sensed operating condition, such as engine speed, or on-plane and off-plane operation of the boat. The drive is typically trimmed out at high speeds and trimmed in at lower speeds. The system of the foregoing patent is automatically responsive to move the drive unit to preselected trim positions characteristic of the boat on which it is used.

U.S. Pat. No. 4,718,872 describes a system for automatically adjusting the trim of a marine drive unit by sensing an increase in boat speed and adjusting the trim until the boat speed ceases to increase. The automatic control system is operative to incrementally trim the drive unit in one direction as long as the movement results in an increase in speed and then to trim the drive unit in the opposite direction as long as the adjustment results in an increase in speed.

Although proper trim control has a significant impact on efficient operation of the drive unit, whether for slow speed trolling, acceleration, or high speed cruising, the vertical lift position of the drive unit also has a significant effect on operation in any of these various modes, as indicated previously. The use of engine lift, as well as trim, to optimize performance in various operating modes has substantially increased the complexity of adjustment for the boat operator. As a result, the casual boater will usually not be able to achieve the best overall operating position or will not desire to take the time to achieve it, particularly where frequent changes in operating modes are required.

It would be desirable, therefore, to be able to reposition a marine drive unit at a position defined by a previously determined set of lift and trim positions for each of various boat operating modes. Further, it would be desirable to be able to reset the lift and trim positions based on changes in various boat operating conditions.

SUMMARY OF THE INVENTION

The present invention is directed to a system for optimizing the operation of a marine drive unit the position of which is independently variable by separately operable trim and vertical lift systems. The system includes trim and lift position sensors, the output signals of which are stored by the control system, such as a microprocessor, such that the trim and lift positions for any previously established drive unit operating mode may be subsequently used to automatically return the drive unit to that particular position. Automatic repositioning is accomplished by manual selection of one of several operating modes, such as trolling, acceleration, or cruising. Automatic movement to a pre-established uppermost trailering position may also be provided.

The system includes appropriate controls based on sensed boat speed (MPH) or engine speed (RPM) to preclude return to one of the pre-established operating positions when such return would be impractical or potentially hazardous. Thus, the microprocessor based control system utilizes boat speed output signals to limit operation of the trim and lift systems to pre-selected trolling, acceleration, or cruising positions. Sensed engine speed is also used to prevent automatic movement of the drive unit to the trailering position unless the engine is stopped.

Preferably the control system operates to automatically reposition the drive unit in a pre-established position by sequential operation of the lift and trim systems. Also, the control system preferably uses a set point tolerance range for the sensed lift and trim used to establish the drive unit positions in each operating mode. The set point range allows automatic return with a tolerance that provides optimized operation with a positioning precision consistent with a practical level or control.

The system of the present invention may utilize or be combined with other automatic protection and/or optimization systems used on marine drive units which provide both lift and trim/tilt functions.

BRIEF DESCRIPTION OF THE DRAWINGS

FIGS. 6*a* and 6*b* comprise a somewhat generalized logic diagram showing operation of the system of the present invention and including elements of other optimization and protective systems with which it may be used.

FIGS. 7*a* and 7*b* comprise a logic diagram showing operation of one of the several automatic drive unit positioning routines forming a part of the system of the present invention.

DETAILED DESCRIPTION OF THE PREFERRED EMBODIMENT

Figure 1:
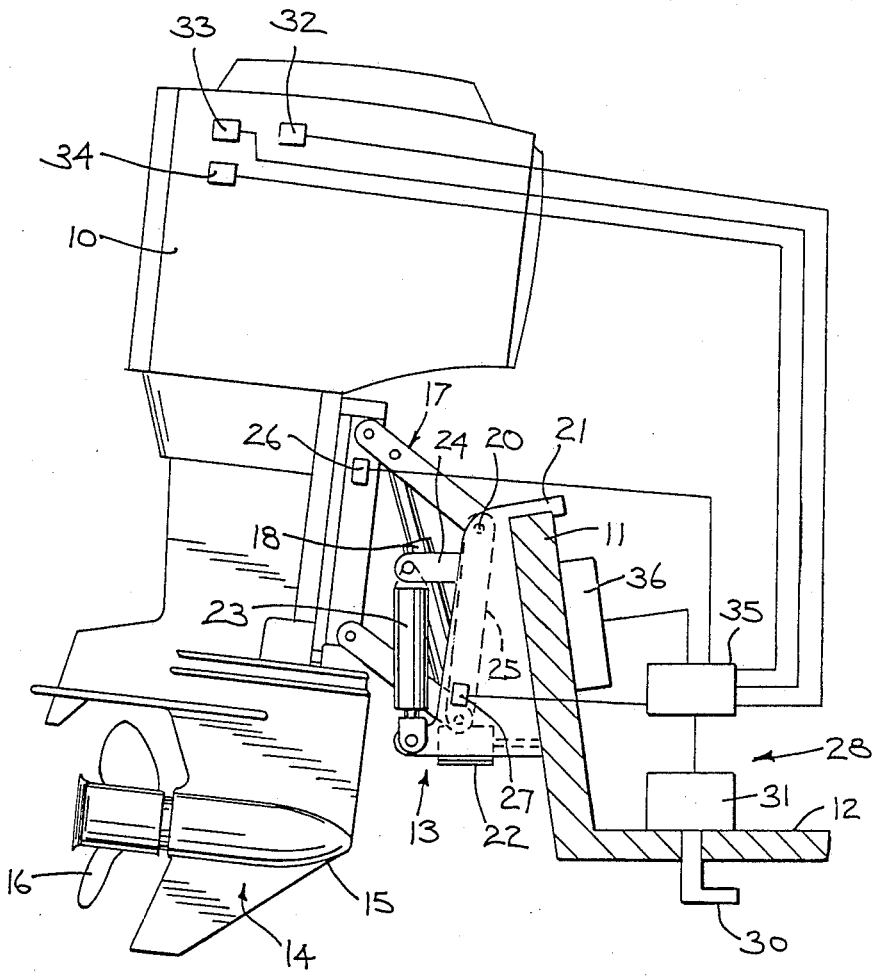
FIG. 1 is a side elevation of an outboard motor attached to a boat by means of a transom extension assembly which includes apparatus for lifting and/or trimming and tilting the motor with respect to the boat, the motor being shown in a typical cruising position.

In FIG. 1, an outboard motor 10 is mounted to the transom 11 of a boat 12 with a transom extension mounting assembly 13. The mounting assembly 13 positions the motor 10 spaced aft of the transom and is adapted to provide vertical movement to lift or lower the motor with respect to the boat, to provide trim movement for limited rotation of the motor about a horizontal access to vary the angle of the propulsive thrust vector, and to provide tilting movement of the motor about the same horizontal axis but to a substantially greater degree as for trailering the motor.

The outboard motor 10 includes the usual lower drive unit 14, including a gear case 15 and a propellor 16. The transom extension mounting assembly 13 includes a pivotally connected quadrilateral linkage 17, opposite sides of which are interconnected by a lift cylinder 18. Extension of the lift cylinder causes the linkage 17 to collapse and the outboard motor 10 to be lifted vertically. Conversely, retraction of the lift cylinder 18 result in vertical downward movement of the motor.

The mounting assembly 13 is pivotally attached at its upper end to the upper end of a transom bracket 21 by a trim/tilt pivot 20. A trim cylinder 22 (or pair of trim cylinders) is attached to the lower end of the mounting assembly 13 and extension of the trim cylinder causes pivotal trimming movement of the mounting assembly and attached outboard motor about the trim/tilt pivot 20 to vary the thrust vector of the drive unit 14. A tilt cylinder 23 is attached at one end to a lower integral extension of the transom bracket 21 and at its upper end to a generally horizontal arm 24 forming an integral rearward extension of the forward vertical leg 25 of the linkage 17. Extension of the tilt cylinder 23 results in rotation of the linkage 17 and attach motor 10 about the trim/tilt pivot 20 beyond the more limited trim movement provided by extension of the time cylinder 22.

The hydraulic pump, motor and fluid reservoir for operation of the lift, trim and tilt cylinders 18, 22 and 23, respectively, may be mounted on the extension assembly 13, in which case only electric power to operate the motor for driving the hydraulic pump need be supplied to the assembly. Alternately, the pump, motor and reservoir may be mounted within the boat with appropriate hydraulic lines extending to the several cylinders. The lift, trim and tilt cylinders may, with appropriate valving and controls, share a common motor, pump and reservoir or can be independently operated.

The outboard motor 10 in FIG. 1 is shown disposed in a typical cruising position with the motor lifted "up" and trimmed "out" with respect to the boat transom 11. The "up" lift is provided by extension of the lift cylinder 18 and the "out" trim by extension of the trim cylinder 22. The amount of lift and trim (i.e., the relative extension of cylinders 18 and 22) is dependent upon the throttle setting, (boat speed), environmental conditions such as wave height and wind velocity, and boat characteristics such as hull design, loading and balance.

Figure 2:
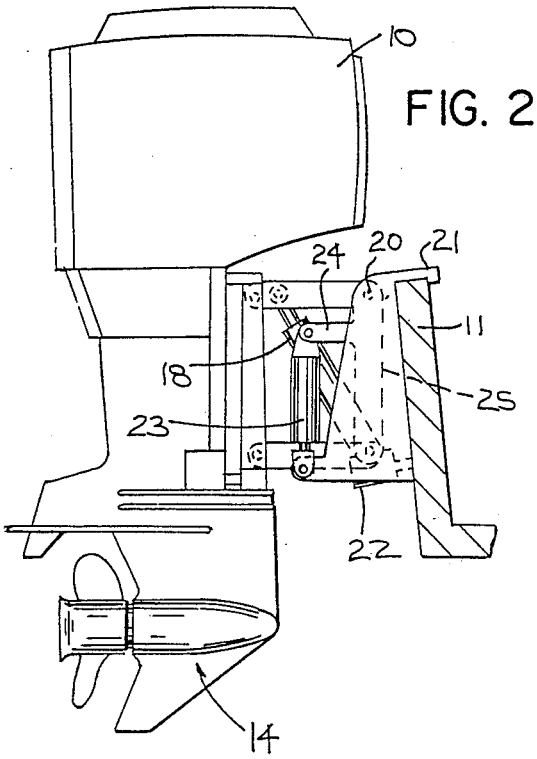
FIG. 2 is a side elevation similar to FIG. 1 showing the motor in a typical acceleration position.

In FIG. 2, the motor 10 is shown in a typical acceleration position with all of the cylinders fully or nearly fully retracted to provide substantial lift cylinder movement in the "down" direction and trim cylinder movement in the "in" direction. Significant "down" lift and "in" trim typically provide optimum accelerative thrust with the other factors and characteristics mentioned above effecting the relative position of the lift cylinder 18 and trim cylinder 22.

Figure 3:
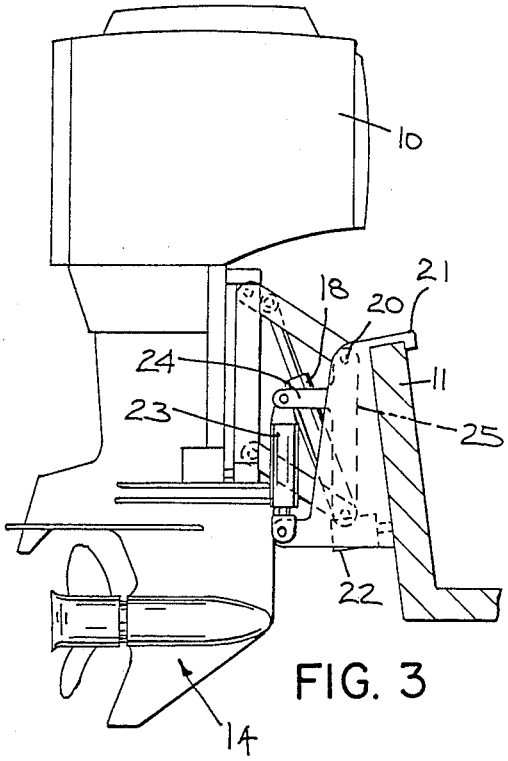
FIG. 3 is a side elevation similar to FIGS. 1 and 2 showing the motor in a typical trolling or shallow water position.
Figure 4:
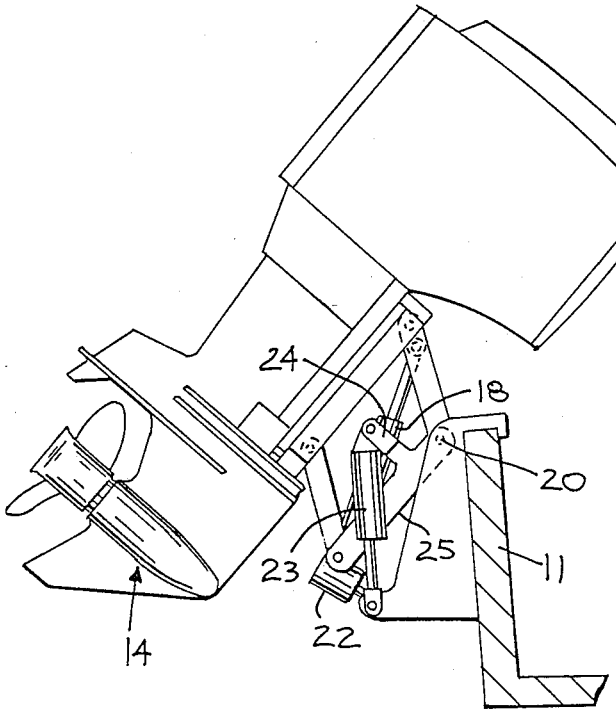
FIG. 4 is a side elevation similar to FIGS. 1–3 showing the motor in a typical trailering position.

In FIG. 3, a typical trolling position of the motor is shown and it is achieved essentially through extension of the lift cylinder 18 to provide vertical "up" lift with little or no trim movement. In FIG. 4, full vertical lift and full pivotal tilt are provided by complete extension of the lift and tilt cylinders 18 and 23, respectively. This provides a typical trailering position which, of course, may be varied substantially by some retraction of either or both of the lift and tilt cylinders. In the positions shown, the trim cylinder 22 is no longer operative and is simply carried away from engagement with the transom bracket 21 as the tilt cylinder 23 is extended.

Because the position of the drive unit 14 of the motor 10 with respect to the boar 12 is an essential element of the control system of the present invention, means for sensing the position of the drive unit and generating output signals representative of the various positions is necessary. Referring to FIG. 1, a lift sensor 26 is attached to the transom extension mounting assembly 13 and may comprise an electronic position transducer adapted to monitor relative movement between two legs of the linkage 17 and to generate appropriate analog signals corresponding to the relative positions. Similarly, a trim sensor 27 may be attached to one leg of the linkage 17 to detect rotational movement of the mounting assembly 13 relative to the transom bracket 21 and to generate appropriate output signals representative of the movement. A single trim sensor 27 may thus be used for both trim and tilt movement about trim/tilt pivot 20. Alternately, separate sensors may be used to monitor trim and tilt.

The system also includes a boat speed sensor 28 comprising the conventional combination of a pitot tube 30 and pressure transducer 31. Mounted on the outboard motor 10 are an engine speed sensor 32 to monitor the rotational rate (RPM) of the engine crankshaft, a pressure sensor 33 to monitor cooling water pressure in the engine cooling system, and a temperature sensor 34 to monitor engine operating temperature. The functions of the various additional sensors in the system of the present invention or other systems with which it may be used will be described more fully hereinafter. The analog signals from the various sensors 26–28 and 32–34 are fed to an analog to digital convertor 35 to provide appropriate input signals to the lift, trim and tilt motor control 36 which includes a programmed microprocessor.

Figure 5:
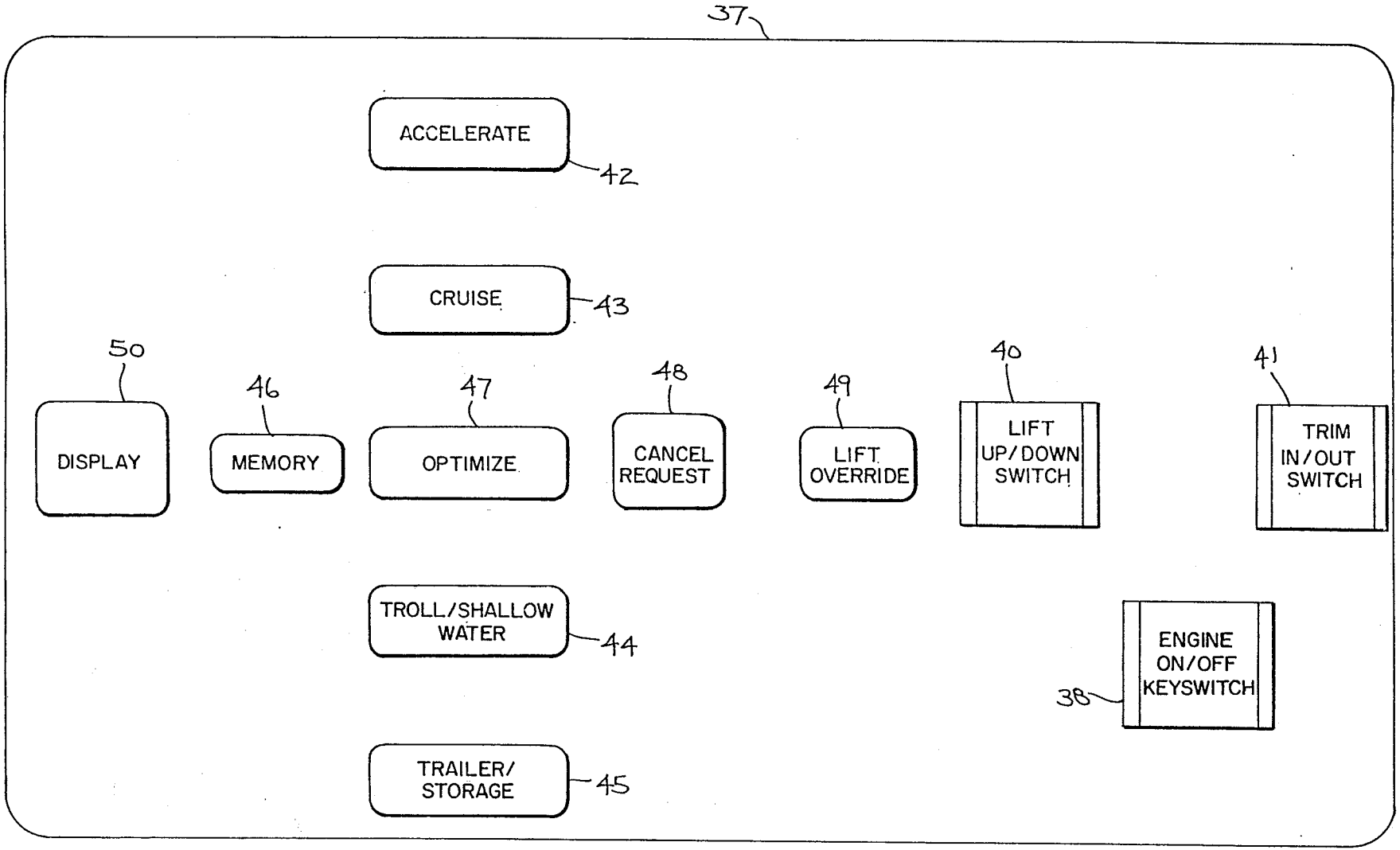
FIG. 5 shows a keyboard arrangement for the operation of the system of the present invention.

FIG. 5 shows a keyboard 37 which may be used by the boat operator to operate the system of the present invention and related systems in which it may be incorporated or with which it may be used. The keyboard includes a conventional engine on/off key switch 38, manually operable lift up/down switch 40 and trim in/out switch 41. Switch 41 may provide a combined trim and tilt function, the tilt cylinder 23 being automatically operable after the trim cylinder 22 has reached the end of its stroke to continue upward pivotal movement of the drive unit about trim/tilt pivot 20. Each of the automatic position optimizing functions of the present invention may be selected by engaging an accelerated button 42, a cruise button 43, a trolling (or shallow water) button 44 and a trailering button 45. A memory button 46, used in conjunction with one of the buttons 42–45, is used to store a current drive unit position for subsequent automatic repositioning, as will be hereinafter described. An optimize button 47 controls a system not part of the present invention which automatically operates the lift and trim mechanisms to orient the drive unit for optimized top speed or optimized cruising speed and fuel consumption. A cancel button 48 is used to halt any lift, trim or tilt movement associated with any of the foregoing functions. The keyboard may also include a graphic and/or digital display 50 of the various drive unit positions and memory points.

Figure 6B:
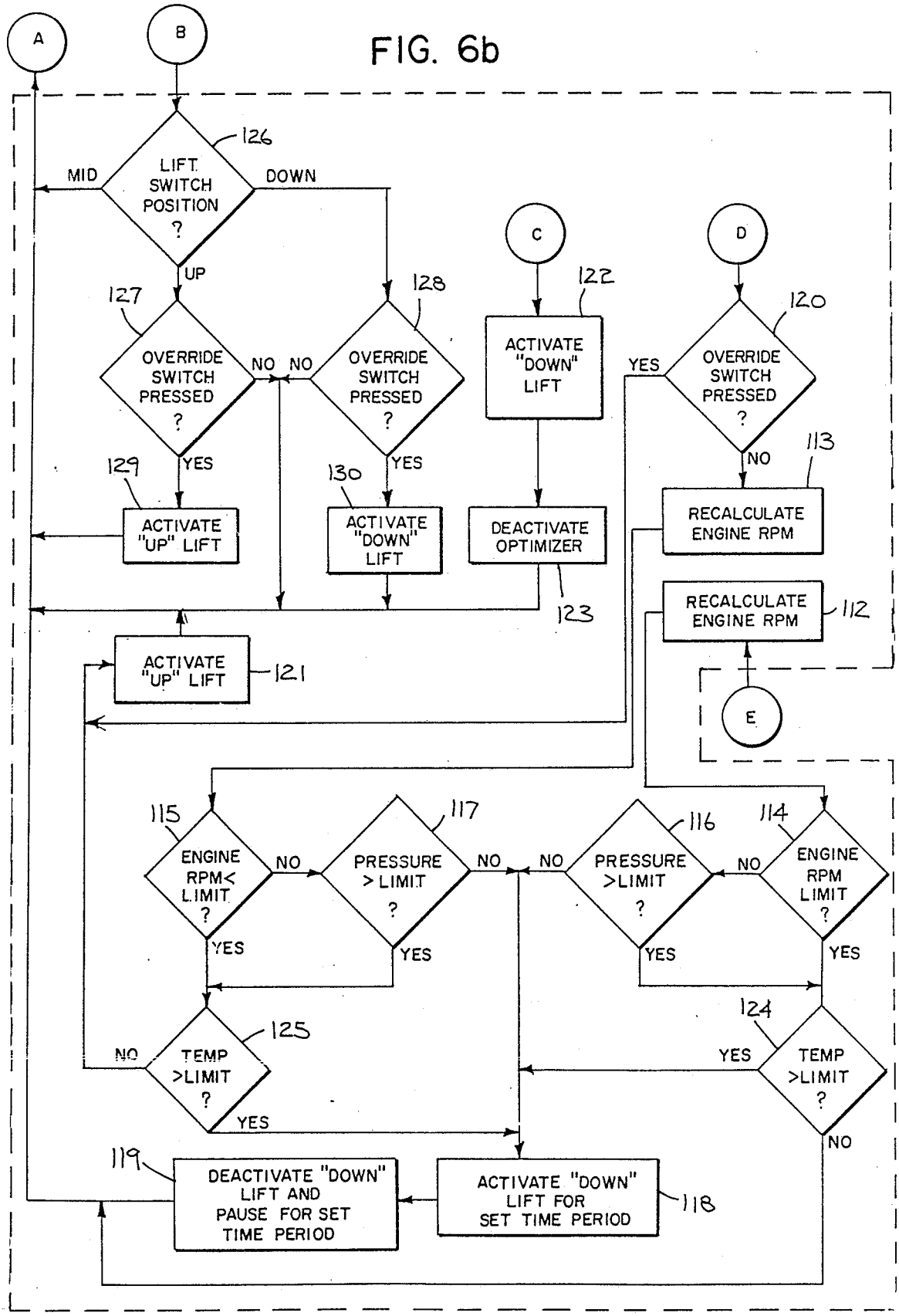

The logic diagram of FIGS. 6*a* and 6*b* shows the operation of the optimization system 51 of the present invention (enclosed by dashed lines) and the manner in which the system may be tied to other known automatic optimization and/or engine protection systems. Certain of the control parameters for the system are pre-programed and entered into the microprocessor forming part of the control 36. Other parameters are entered by the boat operator and stored in the microprocessor memory for selective access by the operator to subsequently reposition the drive unit.

Entry into the system 51 is effected by turning the engine key switch 38 to the "on" position at decision step 52. With the engine running, the boat operator may establish a position for the drive unit 14 for a particular boat operating function by adjusting the lift and trim via manual operation of the lift and trim switches 40 and 41. Adjusting the lift and trim in conjunction with a selected boat speed allows the boat operator to find an optimized drive unit position for a particular operating function. For example, with the boat on plane and the throttle set at a selected cruising speed, the operator may manually adjust the lift cylinder 18 and trim cylinder 22 (FIG. 1) to optimize speed at that throttle setting. Similarly, as shown in FIGS. 2 and 3, the operator may manually adjust lift and trim to establish optimum of substantially optimized positions for acceleration from a low speed or for trolling or shallow water operation at a low speed. With the key switch "on" at decision step 52, but the engine not running, the lift and tilt cylinders may be manually extended to establish a drive unit position appropriate for trailering the boat and motor, as shown in FIG. 4.

Obviously, depending upon the various characteristics of the boat and the manner in which it is loaded, and environmental conditions, as indicated above, substantial trial and error adjustment requiring a significant amount of time may be required to establish any one of the drive unit positions for cruising, acceleration, trolling or trailering. However, once the operator has established a suitable drive unit position, the system of the present invention provides the means for storing the sensed position in the microprocessor memory for use in automatically repositioning the drive unit. Thus, referring again to FIG. 6, if the memory button 46 is pressed at decision step 53 the microprocessor timer is activated at process step 54 for a pre-set time limit. During that time period, the operator may enter the drive unit position measured by lift and trim/tilt sensors 26 and 27 into the microprocessor memory simply by pushing the operating function button relating to that drive unit position. Thus, for example, pressing the accelerated button 42 at decision step 55 will cause the lift and trim positions to be read and stored in the acceleration memory at process step 56.

In a similar manner, pressing the troll/shallow water button 44 at decision step 57 will result in the entry and storage of the sensed drive unit position in the troll memory at process step 58. The cruise position is likewise set and stored by pushing the cruise button 43 at decision step 60 to enter and store the position in the cruise memory at process step 61. Finally, to enter the trailering position, the trailer button 45 is pressed at decision step 62 and the sensed positions of lift and tilt are read and stored in the trailer memory at process step 63. The initialization of the timer at 54 as a result of activating the memory button at decision step 53 requires entry of the selected position into memory by pressing the appropriate button at one of the decision steps 55, 57, 60 or 62 before the time limit has been exceeded. Otherwise, at decision step 64, the memory enter function will be canceled and the system will return to initial decision step 52. It should be noted that pressing the cancel button 48 at decision step 65 prior to entry into storage of a sensed position will also cause the system to recycle to start.

Assuming one or more drive unit positions have been stored in the microprocessor memory as described above, and the memory button has not been pressed at decision step 53, the system automatically checks the position of the lift switch 40 at decision step 66. In order to enter into an automatic repositioning subroutine, yet to be described, the lift switch 40 must be in its neutral or "mid" position (i.e., not manually activated in either the up or down direction). With the lift switch in the mid position, activation of the acceleration button 42 by the operator at decision step 67 will cause the system to enter the acceleration position subroutine 68, shown in detail in FIGS. *7a* and *7b*.

Entry into acceleration positioning subroutine 68 first causes the microprocessor to check current boat speed, sensed by boat speed sensor 28, and compare it to an acceleration speed limit programmed into the microprocessor. The limit which, for example may be in range of 10–15 MPH precludes automatic drive unit repositioning when current boat speed is above the limit. This is because there is limited benefit in attempting to optimize the drive unit position for acceleration when the boat is already above a certain minimum speed. If the boat speed is not above the acceleration speed limit at decision step 70, the system moves to decision step 71 where it compares the actual drive unit lift position, as sensed by lift sensor 26, with the position previously established at decision step 55 and stored in memory at process step 56. The accuracy of a typical lift sensor 26 would have a tolerance of some amount (e.g. + or − ¼ inch) or vertical drive unit movement. If the sensed lift position is higher than the stored position, the lift cylinder 18 is automatically activated at process step 72 to retract and move the drive unit down. The downward movement of the lift continues for a pre-set period of time at process step 73 and is stopped after that time at process step 74. The system then pauses for a pre-set time at process step 75 and, at process step 76, drive unit position is again checked. At decision step 77 the current drive unit lift position is compared with the stored lift position and, if it is still high, the system automatically recycles to process step 72 to move the lift down another icremental amount. Before recycling, however, the system checks to see if the cancel button 48 has pressed at decision step 78 and, if it has, automatic recycle is aborted and the system exits the subroutine 68 and returns to start at decision step 52 (FIG. 6).

If the current drive unit lift position is not above the stored position at decision step 77, the system moves to decision step 80 (FIG. *7b*) where the current drive unit trim position is compared to the stored acceleration trim position (from process step 56) and, if the current and stored trim positions do not correspond within an allowable tolerance (e.g. + or −¼°), automatic adjustment is effected. In the drive unit is trimmed "in" beyond the stored position, the control 36 activates the trim cylinder 22 to trim the drive unit "out" for a predetermined time, halt the trim out movement, pause for a pre-set time, and then recalculate current trim position, as indicated in process steps 81–85. At decision step 86, the current trim position determined at process step 85 is compared with the stored trim position and, if it is still inside the stored position, the system automatically recycles to process step 81 to trim the drive unit out another incremental amount, unless the routine is manually cancelled at decision step 87. If the actual trim position at the initial or any subsequent check at decision step 86 equals the stored trim position (within some allowable tolerance), acceleration repositioning of the drive unit is complete and the subroutine is halted with the system returning to decision step 52 in FIG. 6.

If the actual lift position at decision step 71 is below the stored acceleration lift position, the control 36 acts to effect an incremental "up" lift to the drive unit and compare the new lift position to the stored position in steps 88–93, in the same manner as previously described with respect to steps 72–77. If after initial adjustment the drive unit position is still too low at decision step 93, automatic recycling and incremental "up" lift is effected, subject to manual cancellation at decision step 94, all in the manner previously described.

When automatic upward adjustment of the lift brings the drive unit to the stored lift position, as determined at decision step 93, the logic moves to decision step 80 (FIG. *7b*) where, if the current trim position is outside the stored acceleration trim position, automatic incremental trim "in" is effected via steps 95–100 until the drive unit is at the stored trim position (or within system tolerance limits thereof). As with the exit from decision step 86, when proper trim position has been reached, a similar equality at decision step 100 results in deactivation of the acceleration positioning subroutine 68 with automatic recycle back to system start in FIG. 6.

Figure 7B:
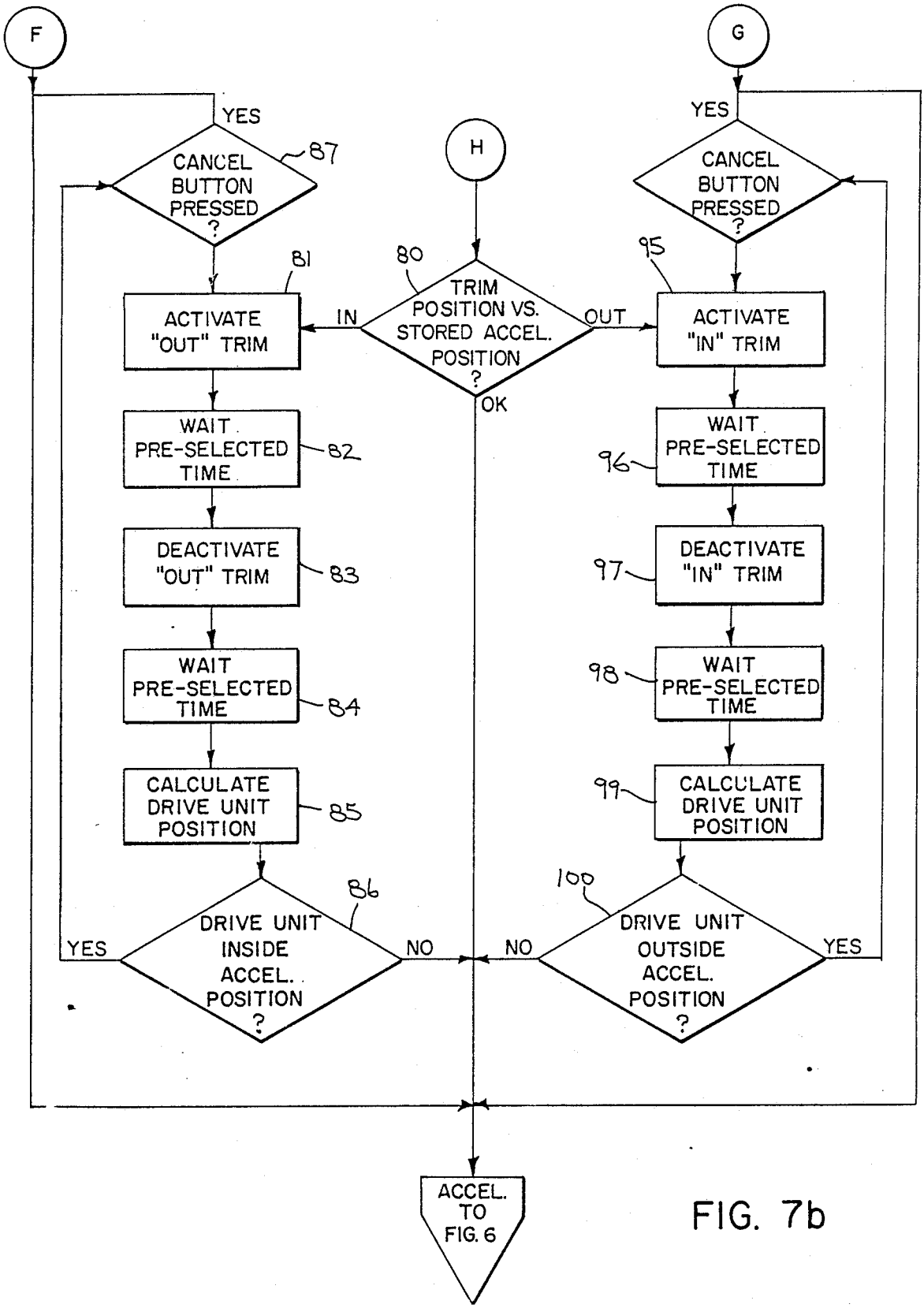

Also, as shown in FIG. 7, if at either decision step 71 or 80 the actual lift or trim position, respectively, is at or within system tolerance limit of the stored position, no automatic adjustment is effected ("OK" output) and the system moves on to the next step.

If appropriate trolling and cruising positions have been established and stored at process steps 58 and 61, respectively, subsequent activation of the trolling or cruise buttons 44 or 43 will effect operation of troll positioning subroutines 104 or cruise positioning subroutine 105, respectively. Both the troll and cruise positioning subroutines 104 and 105 operate to effect automatic lift and trim adjustment in either direction, as required, in exactly the same manner as previously described with respect to acceleration positioning routine 68. Obviously, the trolling and cruising subroutines are responsive to the predetermined lift and trim positions stored in the respective memories at process steps 58 and 61. In addition, each of the subroutines 104 and 105 is responsive to operative only below a pre-programmed speed, similar to the acceleration speed limit utilized at decision step 70 in subroutine 68. For the troll positioning subroutine 104, a speed in the range of 3–4 MPH may, for example, be selected. Thus, the troll positioning subroutines is inoperative above that speed limit. Similarly, a cruise speed limit in the range, for example, of 20–30 MPH may be utilized in the cruise positioning subroutine 105. That range represents the plane speed for most boats and it would generally not be particularly effective to automatically reposition the drive unit for better optimization above that speed.

The trailering position subroutine 107, which is activated by pressing the trailering button 45 at decision step 106, operates with a slightly different control parameter based on engine speed rather than boat speed and utilizes the separate tilt cylinder 23, but otherwise acts to automatically reposition the drive unit in a logical process identical to that followed in subroutines 68, 104 and 105. Referring to decision step 70 in the acceleration positioning subroutine 68 of FIG. *7a*, the trailering position of subroutine 107 utilizes a signal from engine speed sensor 32 rather than a boat speed signal. Because movement to a trailering position is not effected while the engine is running (for obvious reasons of performance and safety), the subroutine is inoperative unless the sensed engine speed (RPM) is zero. Operation of the trailering position subroutine adjusts the vertical lift in either direction, as required, in the same manner as lift adjustment in the acceleration, trolling or cruising subroutine. However, operation of the trim cylinder typically provides only limited upward rotation of the motor and drive unit about the trim/tilt pivot 20 and, therefore, the greater displacement and upward tilting provided by the tilt cylinder 23 is utilized to establish the trailering position. In automatic repositioning by activation of the trailering position subroutine 107, drive unit tilt position (instead of trim position) is sensed and compared to the preselected tilt position stored at process step 63 in the main system 51. Automatic position adjustment otherwise occurs in the same manner previously described.

The system of the present invention may also include or be utilized with other automatic optimization and/or engine protection routines. Referring again to FIG. 6, the microprocessor control 36 may also include a speed optimization system 110 of the type described, for example, in co-pending U.S. patent application entitled "Speed Optimizing Positioning System for a Marine Drive Unit", filed on July 13, 1988. The optimizing system is activated by pressing the optimize button 47 at decision step 108 and operates to automatically position the drive unit lift and trim to provide top operating speed at a given throttle setting. The optimizing system 110 differs from the previously described acceleration cruise and trolling subroutines in that it does not utilize manually established lift and trim positions stored in the microprocessor memory, but rather starts with an existing boat speed signal and is operative regardless of drive unit position. However, the speed optimization system may be subject to automatic override by an engine protection system of the type to be described below.

The system of the present invention may also include the features of an automatic engine protection system of the type disclosed in co-pending U.S. patent application Ser. No. 172,399, filed Mar. 24, 1988, and entitled "Position Control System for a Marine Propulsion Device". In that protective system, an undesirable operating condition generates a sensor signal to the control 36 to automatically retract the lift cylinder 18 and lower the drive unit to a position intended to eliminate the undesirable condition. The conditions monitored and operative to generate the control signals are combined high engine speed and low cooling water pressure, and high engine temperature. The protective system is shown in the dashed outline portion 111 of FIG. 6. The system 111 is operative when the lift switch 40 is in the "mid" position or the "up" position at decision step 66, but since its function is to lower the drive unit, it is not operative when the lift switch is toggled "down" by the operator. As is more fully described in the above mentioned patent application, the system constantly monitors engine RPM as sensed by engine speed is sensor 32 at process steps 112 and 113 if engine speed is below a pre-set limit at decision steps 114 and 115 and a low cooling water pressure is sensed at decision step 116 or 117, the lift is activated to move the drive unit down one increment at process steps 116 and 117. The override button 49 may be utilized at decision step 120 to continue manually selected "up" lift movement via process step 121 even if an undesirable operating condition has been sensed. The override button 49 may be utilized at decision step 131 to continue manually selected "no movement" lift positioning, via process step 52, even if an undesirable operating condition has been sensed. Manual selection of the "down" mode of the lift switch 40 at decision step 66 will, of course, effect downward movement of the drive unit at process step 122. This will also automatically deactivate the optimizer. The sensing of an engine temperature above a pre-set limit at decision step 124 or 125 will also result in incremental downward movement of the lift and drive unit at process steps 118 and 119. If the engine key switch 38 is not on at decision step 52, operation of the lift switch 40 in either the up or down direction at decision step 126 requires simultaneous operation of the override button 49 at decision step 127 or 128 to effect up or down movement, respectively, at process step 129 or 130. A more complete description of the operation of the protective system 111 is set forth in the above identified co-pending application.

The system of the present invention provides substantial optimization of the most important operational features of the marine drive unit including lift and trim/tilt movement and, when combined with other optimization and/or protective systems, provides a boat operator virtually complete push button control. The system of the present invention eliminates the difficult and tedious job faced by even a skilled boat operator in trying to adjust both lift and trim for a particular operating mode each time the drive unit position is changed. Even the casual boater does not have to settle for poor operation position because of difficulty in obtaining it and, with the present system, the operator can repeatedly reposition the drive unit automatically according to pre-set positions providing good performance, yet the system is flexible and allows any preset positions to be varied to accommodate changing conditions.

We claim:

1. A system for optimizing the operation of an engine-driven marine drive unit for a boat comprising:

means for trimming the drive unit relative to the boat;

means for moving the drive unit vertically relative to the boat;

means for sensing the trim position of the drive unit with respect to the boat and for generating an output signal representative of the drive unit trim position;

means for sensing the vertical position of the drive unit with respect to the boat and for generating an output signal representative of the drive unit vertical position; and control means operative to receive and store said output signals, said control means being responsive to a selected input signal to cause the trimming means and the moving means to move the drive unit to a position based on stored output signals.

2. The system as set forth in claim 1 wherein said means for trimming and said means for moving the drive unit comprises, respectively, a separately operable trim system and a separately operable lift system.

3. The system as set forth in claim 2 wherein said control means in operative to receive and store drive unit position output signals selectively representative of a trolling position, an acceleration position and a cruising position.

4. The system as set forth in claim 3 wherein the storage of said drive unit position output signals is effected manually.

5. The system as set forth in claim 4 including means for manually selecting an input signal corresponding to a selected drive unit position.

6. The system as set forth in claim 5 wherein said control means is responsive to said input signal to effect movement of the drive unit to one of said trolling, acceleration and cruising positions.

7. The system as set forth in claim 6 including means for sensing boat speed and for generating an output signal indicative of boat speed.

8. The system as set forth in claim 7 wherein said control means in operative in response to said boat speed output signal at the time of selection of said input signal to limit operation of said trim system and said lift system.

9. The system as set forth in claim 8 wherein said control means is operative in response to the input signal for moving the drive unit to the trolling position and a boat speed output signal representative of a boat speed less than a trolling speed limit.

10. The system as set forth in claim 8 wherein said control means is operative in response to the input signal for moving the drive unit to the acceleration position and a boat speed output signal representative of a boat speed less than an acceleration speed limit.

11. The system as set forth in claim 8 wherein said control means is operative in response to the input signal for moving the drive unit to the cruising position and a boat speed output signal representative of a boat speed less than a cruising speed limit.

12. The system as set forth in claim 8 wherein said control means is operative to effect sequential operation of said lift and trim systems.

13. The system as set forth in claim 12 including a setpoint range for each of said drive unit positions and wherein said control means is operative in response to drive unit position output signals representative of drive unit positions outside said setpoint range for the position selected.

14. The system as set forth in claim 5 including means for sensing engine speed and for generating an output signal indicative of engine speed.

15. The system as set forth in claim 14 wherein said control means is operative to receive and store a drive unit position output signal selectively representative of a trailering position.

16. The system as set forth in claim 15 wherein said input signal is effective to move the drive unit to said trailering position.

17. The system as set forth in claim 16 wherein said control means is operative in response to said engine speed output signal at the time of selection of the trailering position input signal to limit operation of said trim system and said lift system.

18. The system as set forth in claim 17 wherein said control means is operative in response to an engine speed output signal representative of zero engine speed.

* * * * *